United States Patent [19]

Löliger

[11] Patent Number: 4,893,659

[45] Date of Patent: Jan. 16, 1990

[54] FILLING HEAD APPARATUS FOR ASEPTICALLY FILLING A PACK

[75] Inventor: Willi Löliger, Konolfingen, Switzerland

[73] Assignee: Nestec S. A., Vevey, Switzerland

[21] Appl. No.: 157,383

[22] Filed: Feb. 18, 1988

[30] Foreign Application Priority Data

Mar. 2, 1987 [CH] Switzerland ..... 785/87

[51] Int. Cl.[4] ..... B65B 43/42

[52] U.S. Cl. ..... 141/85; 141/82; 141/105; 141/329; 53/111 R

[58] Field of Search ..... 141/85, 89, 90, 91, 141/92, 98, 69, 82, 1, 11, 105, 100, 329, 330; 52/426, 167, 111 R

[56] References Cited

U.S. PATENT DOCUMENTS

| | | | |
|---|---|---|---|
| 4,245,552 | 1/1981 | Small et al. | 99/483 |
| 4,318,431 | 3/1982 | Evans | 141/90 |
| 4,414,036 | 11/1983 | Anderson et al. | 141/98 X |
| 4,458,734 | 7/1984 | Scholle et al. | 141/5 |
| 4,495,974 | 1/1985 | Pohorski | 141/132 |
| 4,524,563 | 6/1985 | Sassi | 53/426 |
| 4,559,961 | 12/1985 | Anderson et al. | 141/91 X |
| 4,605,047 | 8/1986 | Bausch et al. | 141/83 |

FOREIGN PATENT DOCUMENTS

| | | | |
|---|---|---|---|
| 0072699 | 2/1983 | European Pat. Off. . | |
| 0236107 | 9/1987 | European Pat. Off. . | |
| 1916636 | 10/1970 | Fed. Rep. of Germany . | |
| 1594021 | 7/1970 | France . | |
| 2097770 | 11/1982 | United Kingdom | 141/85 |

*Primary Examiner*—Ernest G. Cusick

*Attorney, Agent, or Firm*—Vogt & O'Donnell

[57] ABSTRACT

A filling head apparatus is provided which has an elongated housing which contains valves for regulating flow of a sterilizing medium and for regulating flow of a fluid to be filled in a pack to a filling head space, the filling head space being defined by one end of the housing, and for regulating emptying of sterilizing medium and residual fluid from the filling head space. A first elongated valve which is centrally disposed within the housing and is longitudinally displaceable for regulating the flow of the sterilizing medium to the filling head space. A second elongated valve for regulating the fluid flow to the filling head space circumscribes the centrally disposed first vavle and is capable of coaxial movement with respect to the first valve. An emptying pipe containing the valve for regulating emptying of sterilizing medium and residual fluid from the filling head space is arranged laterally to the housing at the filling head space.

7 Claims, 4 Drawing Sheets

FILLING HEAD APPARATUS FOR ASEPTICALLY FILLING A PACK

This invention relates to a process for aseptically filling a pack with a fluid and for washing and keeping sterile a filling head space, in which—the pack being sterile and closed—the filling head space and the outer part of the pack intended for the entry of the fluid are sterilised and the pack is filled with fluid. The invention also relates to an apparatus for carrying out this process.

European patent 72 699 already describes a process and an apparatus for the aseptic filling of a pack with a fluid.

This apparatus is attended by the disadvantages that the filling head space is difficult to clean between two fillings and that it can become infected during the introduction of a new pack which would result in disruption of the asepsis. In fact, with this apparatus, the only way of cleaning the filling head space is mechanically which is not sufficiently effective and safe and the risk of disrupting the asepsis may induce bacterial growth which must be avoided.

DESCRIPTION OF THE INVENTION

The invention enables the above-mentioned disadvantages to be overcome with the aid of an inlet for a sterilizing medium of steam or sterile air both for cleaning of the filling head space and for the maintenance of asepsis.

The present invention relates to a process for aseptically filling a pack with a fluid and for washing and keeping sterile a filling head space, in which—the pack being sterile and closed—the filling head space and the outer part of the pack intended for the entry of the fluid are sterilized and the pack is filled with fluid, characterized in that, before, during or after sealing of the pack, a sterilizing medium of steam or sterile air is injected under pressure coaxially of the filling head so that the residual fluid is laterally displaced and the filling head space is protected against infection by maintaining a constant atmosphere of steam or sterile air during the positioning of a new pack.

In the context of the invention, the term "pack" is understood to include both plastic and cardboard packs and also any other type of pack for the food or medical field. The term "fluid" is understood to include both aqueous solutions and milk, fruit juices or more viscous products, such as jam, marmalade and the like, with or without pieces of fruit.

In known processes for cleaning the filling head space, the residual product in the pack is displaced either mechanically or by steam with the pack open. By contrast, according to the invention, the residual product is displaced by a sterilizing medium of steam or sterile air with the pack closed so that the residual product is rejected.

The preliminary sterilization of the filling head space takes place for 2 to 30 seconds at a temperature in the range from 135° to 165° C. and under a steam pressure of from 2 to 6 atmospheres.

On completion of the filling cycle, the cleaning operation takes place with steam under a pressure of 1 to 4 atmospheres for 0.5 to 2 seconds at a temperature of from 120° to 150° C. Where sterile air is used, it is introduced under a pressure of 0.5 to 3 atmospheres and at ambient temperature. So far as the supply of steam or sterile air during changing of the pack is concerned, the feed rate is selected so that a screen is formed, avoiding any form of infection of the head space. It is preferred to work at atmospheric pressure at a temperature of 98° to 110° C. in the case of steam and at atmospheric pressure and ambient temperature in the case of sterile air.

The present invention also relates to an apparatus for carrying out the process described above comprising a filling head, a pack support positioned beneath the filling head and designed to seal the pack on completion of filling, said head comprising a valve to regulate the entry rate of the fluid and means for actuating that valve, characterized in that the filling head additionally comprises a valve to regulate the entry rate of the sterilizing medium of steam or air and means for actuating that valve, the valve being designed to move coaxially in relation to the valve for regulating the entry of fluid and sliding therein, a fluid inlet and outlet pipe and, arranged laterally at the bottom of the filling head, a valve with an emptying pipe for the cleaning operation on completion of filling.

The pack support is formed by jaws to hold the pack in place and a sealing head. At least two types of pack may be envisaged, namely: either a pack with a spout comprising a tearable outer membrane and an inner sealing membrane of the type shown in the drawings and in EP-PS 72 699 or a pack with a spout comprising a tearable outer membrane but not a sealing membrane.

In more detail, the filling head includes an elongated housing having a fluid inlet port and a fluid outlet port and having one end which defines a filling head space. A first elongated valve for regulating the flow of the sterilizing medium is disposed centrally within the housing and is displaceable along its longitudinal axis, its elongation being parallel with the elongation of the housing. A second elongated valve circumscribes and is displaced from the first valve, thereby defining a first passage disposed between it and the first valve for providing a passage for flow of sterilizing medium, and is capable of coaxial movement with respect to the first valve. The second valve is displaced also from the housing thereby defining a second passage between it and the housing for regulating flow of fluid entering the housing from the housing inlet port to the filling head space. Thus, the first passage communicates with a sterilizing medium entry port in the housing for providing for the sterilizing medium to reach and to flow through the first passage between the second valve and the first valve, and the second passage provides for fluid from the housing inlet to flow between it and the housing to the filling head space. An emptying pipe is connected laterally at and to the filling head space for removal of sterilizing medium and residual fluid from the filling head space. A valve for regulating the emptying of the filling head space is positioned in the emptying pipe and is displaceable perpendicularly with respect to the first and second valves. Means are provided for actuating the valves along their respective longitudinal axes.

The valve for regulating the entry of fluid comprises steam inlet passages and an expandable membrane. The valve for regulating the entry of steam or air comprises a knife edge and a central steam inlet passage at its lower end. This valve additionally comprises at its center a cone with a bore for the entry of the sterilizing medium of steam or air during the positioning of a new pack.

The apparatus according to the invention is described in more detail in the following with reference to the accompanying drawings.

DETAILED DESCRIPTION OF THE DRAWINGS

Figure 1:
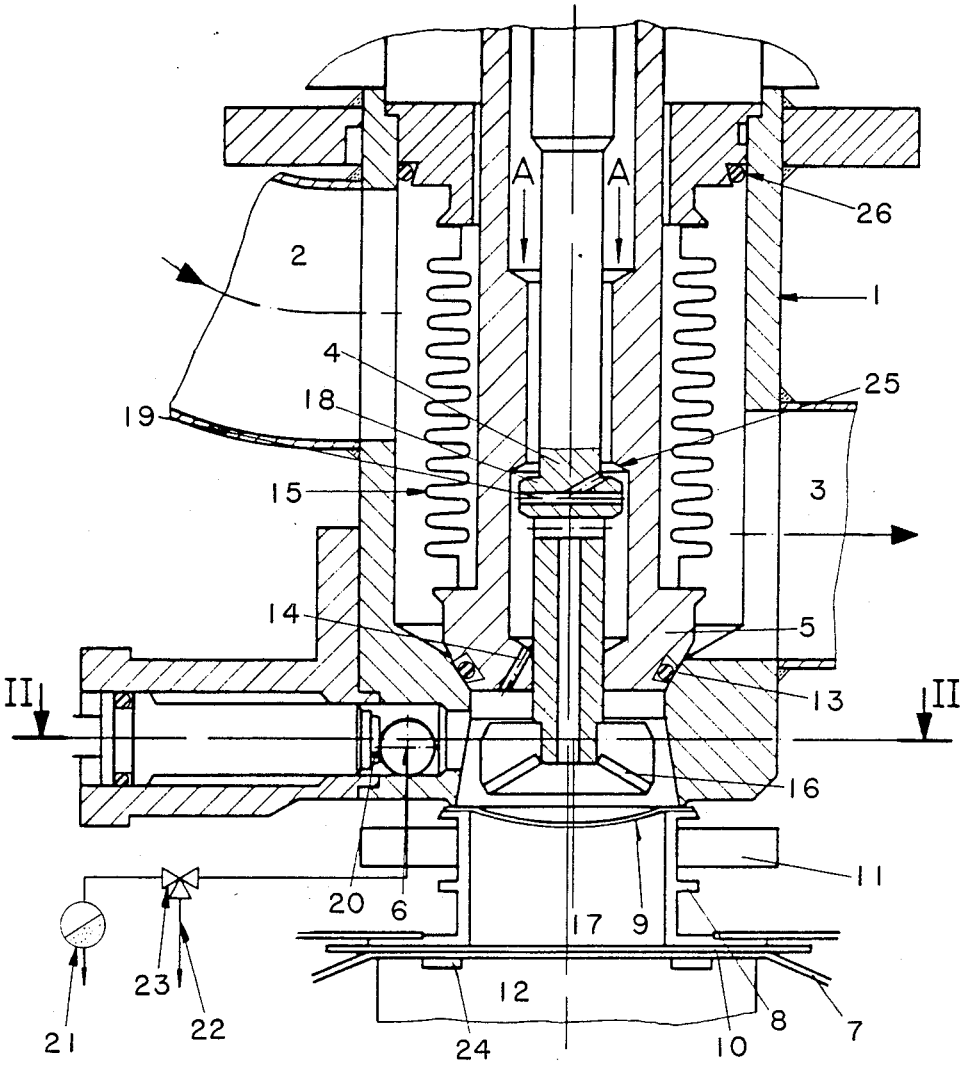
FIG. 1 is a section through the apparatus according to the invention during sterilization of the filling head space.
Figure 2:
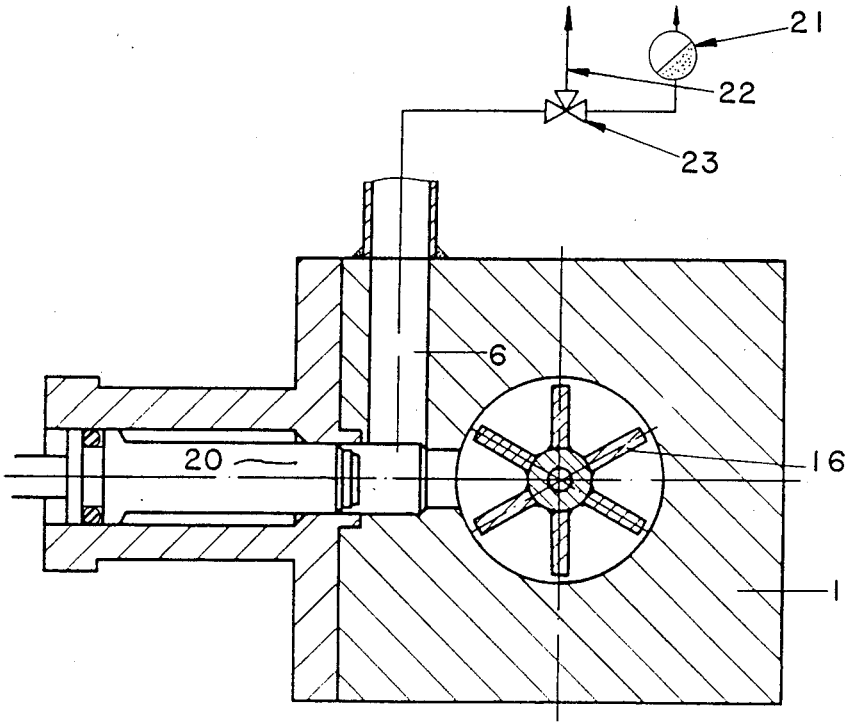
FIG. 2 is a section on the line II—II of FIG. 1.

The filling head, encompassed by an elongated housing denoted by the reference (1) and having one end which defines a filling head space comprises a fluid inlet port (2) and outlet port (3) in the housing sides with a sealing joint (26), a first elongated valve (4) being displaceable along its longitudinal axis [for regulating the fluid entry rate, a valve (5)] for regulating the steam entry rate from a sterilizing medium entry port in the housing end opposite the filling head space, a second elongated valve (5) being displaceable along its longitudinal axis for regulating the fluid entry rate and an emptying outlet pipe (6) connected laterally at and to the filling head space for removal of a sterilizing medium and residual fluid from the filling head space for the cleaning of the filling head. The second valve circumscribes and is displaced from the first valve, thereby defining a first passage disposed between it and the first valve for providing a passage for allowing the sterilizing medium, i.e., steam or sterile air, from the sterilizing medium entry port to flow in the first passage between the second valve and first valve. The second valve is displaced also from the housing thereby defining a second passage between the second valve and housing for allowing of fluid entering the housing from the housing inlet port to flow in the second passage between the second valve and the housing to the filling head space. A pack (7) comprising a spout (8) with a tearable membrane (9) and a sealing membrane (10) is disposed beneath the actual filling head. The pack is held in place with respect to the filling head space by jaws (11) beneath which is arranged the sealing head (12) by which the pack is sealed on completion of filling.

The valves (5) and (4) are designed for coaxial movement and are vertically displaceable by means of pneumatic or similar systems (not shown). The fluid entry valve (5) comprises a joint (13), additional steam entry passages (14) and an expandable membrane (15). At its lower end, the steam entry valve (4) comprises a knife edge (16) and a central steam entry passage (17), thereby providing a third passage and closes the steam entry passages (14) and (17) in its lower position. At its center, it comprises a cone (18) with a bore (19) for the entry of steam during the positioning of a new pack. The emptying outlet pipe (6) for the cleaning and sterilization of the filling head comprises an emptying pipe valve (20) being displaceable along a longitudinal axis perpendicular to the longitudinal axes of the first and second valves, this pipe leading either to a trap (21) or to an emptying pipe (22), a three-way valve (23) establishing the connection.

The Figures show the various steps involved in the filling of the pack. In FIG. 1, the apparatus according to the invention is in the phase of sterilization of the filling head space and the membrane (9). To this end, the fluid entry valve (5) is closed and the steam entry valve (4) is open. The steam under pressure passes through the passages (14) and (17) from A from the sterilizing medium entry port. The lateral valve (20) is open and the steam passes to the trap (21). The sealing head (12) remains cold, but bears against the spout (8).

On completion of sterilization, the stem of the valve (4) descends, closes the passages (14) and (17), the knife edges (16) tear the membrane (9), the valve (20) is closed, the valve (5) is raised and the fluid enters the pack (7) through the inlet (2), the sealing head (12) being of course in its lowered position. This filling phase is not shown.

Figure 3:
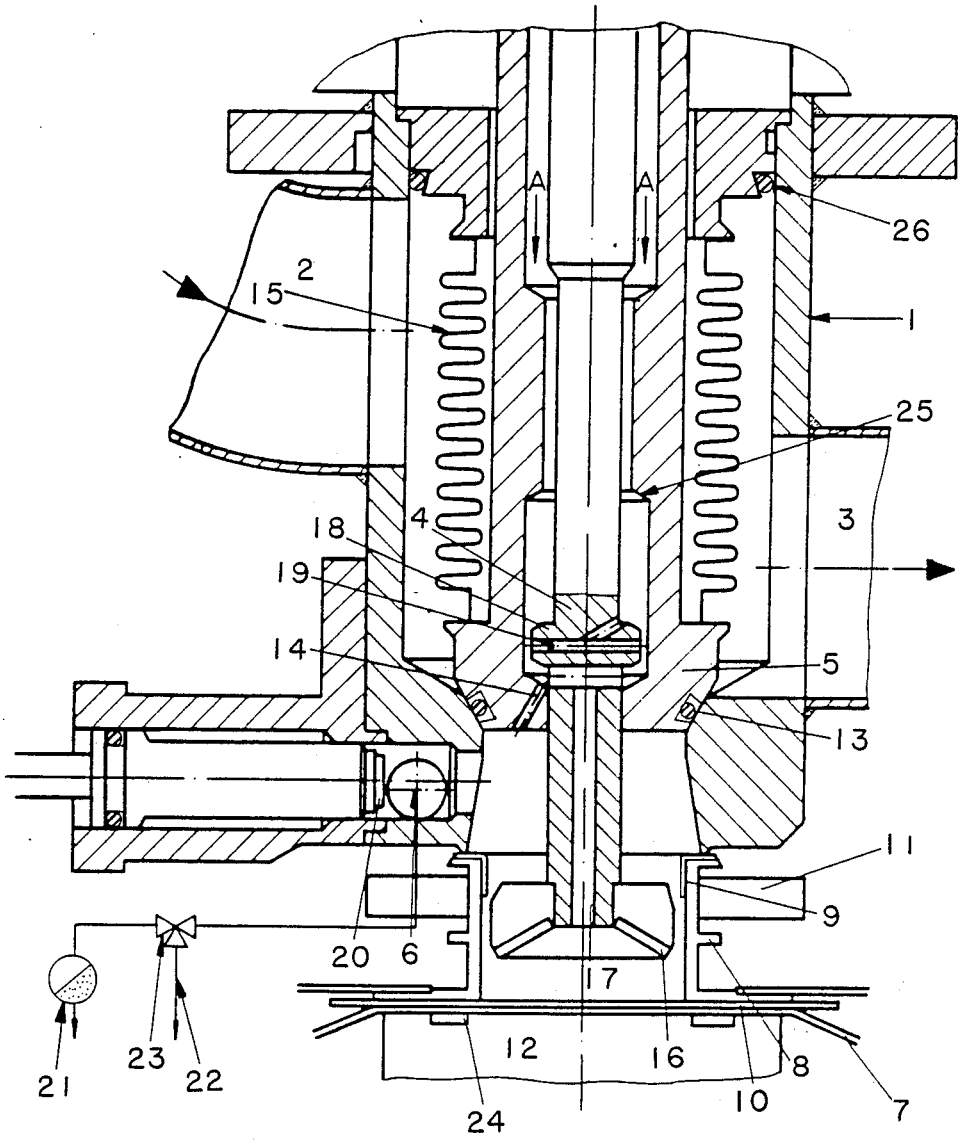
FIG. 3 is a section through the apparatus during the rinsing or washing of the filling head space.

FIG. 3 shows the apparatus according to the invention during the washing or rinsing of the filling head space and sealing of the pack. To this end, the fluid entry valve (5) is closed again and the steam entry valve (4) is opened. The steam passes under pressure through the passages (14) and (17), displacing the residual fluid to the open pipe (6) and into the emptying pipe (22), the sealing head (12) being in its raised position. During or on completion of this cleaning operation, the sealing ring (24) is heated, thus sealing the pack (7). The jaws (11) may then release said pack.

Figure 4:
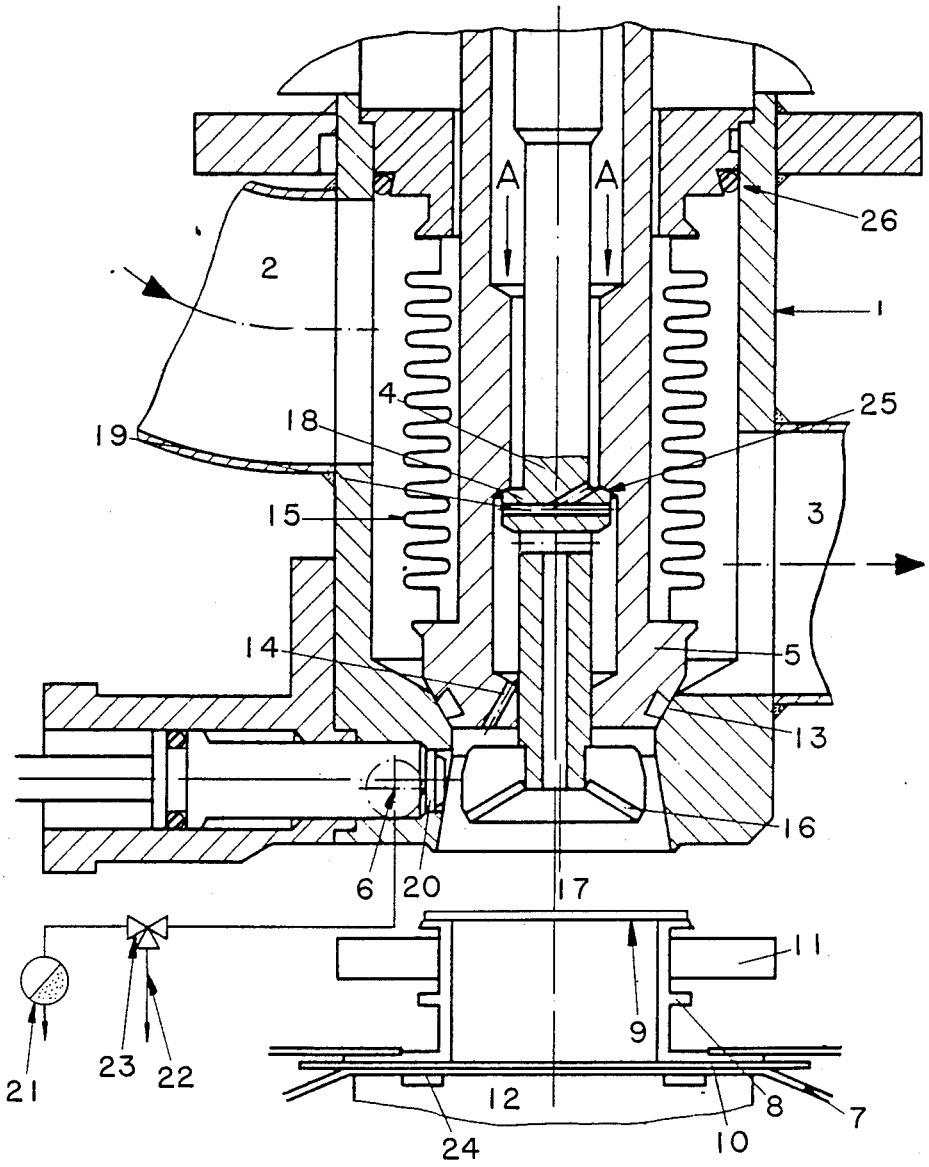
FIG. 4 is a section through the apparatus during changing of the pack.

FIG. 4 shows the apparatus according to the invention before the positioning of a new pack. The fluid entry valve (5) is closed and the steam entry valve (4) is in its highest position so that the cone (18) bears against the seat (25) of the valve (4). The steam arriving from A passes through the bore (19) which gives a small quantity of steam arriving through the passages (14) and (17), thus forming a steam curtain which prevents infection of the filling head space during changing of the pack.

The invention thus provides a highly efficient, safe system in which the risk of infection is minimized by a specific supply of steam both during the sterilization phase and during changing of the pack to be filled.

I claim:

1. A filling head apparatus for aseptically filling a pack comprising:

an elongated housing having a fluid inlet port and a fluid outlet port in the housing sides and having one end defining a filling head space and a second end having a sterilizing medium entry port;

a first elongated valve for regulating flow of a sterilizing medium selected from a group consisting of steam and sterile air for sterilizing the filling head space, the first valve being elongated parallel with the elongation of the housing and being centrally disposed within the housing, the first valve being displaceable along its longitudinal axis;

a second elongated valve for regulating flow of fluid from the housing fluid inlet port to the filling head space, the second valve circumscribing and being displaced from the first valve thereby defining a first passage disposed between the second valve and the first valve which communicates with the sterilizing medium entry port for allowing the sterilizing medium to flow in the first passage between the second valve and the first valve, and being displaceable coaxially with respect to the first valve, the second valve further being displaced from the housing thereby defining a second passage disposed between the second valve and the housing for allowing fluid from the housing inlet to flow in the second passage between the second valve and the housing to the filling head space;

an emptying pipe connected laterally to the housing at the filling head space for removal of sterilizing medium and residual fluid from the filling head space;

an emptying pipe valve for regulating emptying of the sterilizing medium and residual fluid from the filling head space, the emptying pipe valve being positioned with the emptying pipe and being displaceable along a longitudinal axis perpendicular to the longitudinal axes of the first and second valves; and means for actuating the first valve, second valve and emptying pipe valve along their respective longitudinal axes.

2. An apparatus according to claim 1 further comprising a central passage within and along the longitudinal axis of the first valve for providing a third passage which communicates with the filling head space and further comprising a cone with a bore communicating with the first and third passages for allowing flow of sterilizing medium from the first passage to the third passage and filling head space.

3. An apparatus according to claim 1 or 2 wherein the second valve provides additional passages for allowing flow of sterilizing medium from the first passage to the filling head space.

4. An apparatus according to claim 3 wherein the first valve is capable of closing the additional sterilizing medium entry passages in the second valve.

5. An apparatus according to claim 3 wherein a surface of the second valve abutting the second passage has an expandable membrane along its longitudinal axis.

6. An apparatus according to claim 1 or 2 wherein a surface of the second valve abutting the second passage has an expandable membrane along its longitudinal axis.

7. An apparatus according to claim 1 or 2 further comprising a knife edge affixed to the first valve adapted to extend into the filling head space for tearing a membrane of a pack for allowing flow of fluid into the pack.

* * * * *